US006247872B1

(12) United States Patent
Marcato

(10) Patent No.: US 6,247,872 B1
(45) Date of Patent: Jun. 19, 2001

(54) AUDIBLE NIGHT-VISIBLE TRAFFIC STRIPE FOR A ROAD AND METHOD AND APPARATUS FOR MAKING THE SAME

(75) Inventor: Forrest C. Marcato, Pike Road, AL (US)

(73) Assignee: The RainLine Corporation, Montgomery, AL (US)

( * ) Notice: Subject to any disclaimer, the term of this patent is extended or adjusted under 35 U.S.C. 154(b) by 0 days.

(21) Appl. No.: 09/249,492

(22) Filed: Feb. 12, 1999

(51) Int. Cl.[7] ..... E01C 23/16

(52) U.S. Cl. ..... 404/94; 404/14

(58) Field of Search ..... 404/93, 94, 75, 404/14, 15, 16

(56) References Cited

U.S. PATENT DOCUMENTS

| | | | | |
|---|---|---|---|---|
| 3,070,822 | * | 1/1963 | Lipkins | 404/12 |
| 3,094,046 | | 6/1963 | Zipelius . | |
| 3,477,352 | | 11/1969 | Harding et al. . | |
| 3,874,806 | | 4/1975 | Grist et al. | 404/93 |
| 3,886,011 | | 5/1975 | Eigenmann | 156/71 |
| 4,236,950 | * | 12/1980 | Eigenmann | 404/12 |
| 4,248,932 | | 2/1981 | Tung et al. | 428/325 |
| 4,462,547 | * | 7/1984 | Metz | 404/94 |
| 4,565,467 | * | 1/1986 | Eigenmann | 404/72 |
| 4,575,278 | | 3/1986 | Whitney | 404/72 |
| 4,751,140 | | 6/1988 | Ishihara | 428/324 |
| 4,802,788 | | 2/1989 | Smith | 404/93 |
| 4,856,931 | | 8/1989 | Bollag | 404/75 |
| 5,006,010 | | 4/1991 | Duckett | 404/12 |
| 5,114,268 | | 5/1992 | Marcato | 404/92 |
| 5,439,312 | | 8/1995 | Marcato | 404/12 |
| 5,511,896 | | 4/1996 | Marcato | 404/72 |
| 5,642,962 | | 7/1997 | Marcato . | |

FOREIGN PATENT DOCUMENTS

| | | |
|---|---|---|
| 1 238 224 | 6/1988 | (CA) . |
| 30 29 909 | 3/1982 | (DE) . |
| 0 124 946 | 11/1984 | (EP) . |
| 2 375 394 | 7/1978 | (FR) . |
| 1090178 | 11/1967 | (GB) . |
| 2 121 462 | 12/1983 | (GB) . |
| 50-12212 | 2/1975 | (JP) . |
| 6 607 963 | 12/1966 | (NL) . |

OTHER PUBLICATIONS

Pave–Mark Corporation, PM–74 Primer/Sealer System data sheet (not dated).

Pave–Mark Corporation, The Titan II Series data sheet (not dated).

Pave–Mark Corporation, Total Commitment to Your success data Sheet (not dated).

Moderne Markiertechnik, Roadliner (in German) not dated.

(List continued on next page.)

*Primary Examiner*—Thomas B. Will
*Assistant Examiner*—Kristine Markovich
(74) *Attorney, Agent, or Firm*—Burns Doane Swecker & Mathis L.L.P.

(57) ABSTRACT

A traffic stripe including a first profiled portion having improved reflectivity and a second raised portion which provides an audible indication of its presence to a driver. Also, a method and apparatus for applying the traffic stripe including a vehicle having an apparatus for applying the traffic stripe, an applying assembly for dispersing a reflective material over the traffic stripe, another applying apparatus for applying an anti-adhesion agent, and a deformation apparatus disposed rearward thereof for forming interval grooves in the traffic stripe. The application of the anti-adhesion agent directly onto the traffic stripe or onto the deformation apparatus prevents the freshly applied traffic stripe from lifting off the road surface and adhering to the deformation apparatus.

56 Claims, 10 Drawing Sheets

OTHER PUBLICATIONS

Joschu Josef Schnupp KG, Ein Unternehmen mit Linie brochure (in German) (not dated).
R. S. Clare & Co., Ltd., Thermoplastic Road Marking Material (Class A BS 3262: Part 2) brochure (Apr. 1990).
R. S. Clare & Co., Ltd. Aquaflex™ brochure (not dated).
Roadcare Group Limited, Ambassadors for Safety brochure (not dated).
Superfos Dammann–Luxol a/x, Spotflex brochure (in Spanish) (1987).
Unimark Ltd., Road Marking Equipment brochure (not dated).
"Super Line Thermoplastic Corrugation Machine" brochure page, Kikusui Line Co., Ltd. (1985).
"Superline Pavement Marking," Kikusui Line Co., Ltd., Nagoya, Japan (Jul. 20, 1977).
Pave–Mark Corporation, System 1552, Wet Night Visibility brochure (Jul. 1989).
Pave–Mark Corporation, The Apollo II Series, User's Guide & Maintenance Manual (May 1989).
Pave–Mark Corporation, Thermoplastic Materials & Application Equipment brochure (1989).
Pave–Mark Corporation, Hot–Applied Thermoplastic Pavement Marking Materials and Applicating Equipment brochure (not dated).
Pave–Mark Corporation, Hercules™ Road Striping Machine brochure (not dated).
Pave–Mark Corporation, MarkerGrip data sheet (not dated).
Pave–Mark Corporation, PM Eraser, Pavement Marking Remover brochure (not dated).

* cited by examiner

AUDIBLE NIGHT-VISIBLE TRAFFIC STRIPE FOR A ROAD AND METHOD AND APPARATUS FOR MAKING THE SAME

TECHNICAL FIELD

The present invention relates to a traffic stripe applied to a road surface and, in particular, a thermoplastic traffic stripe having a profiled portion including a plurality of spaced grooves that provide improved night visibility and water drainage and a raised profiled portion that provides an audible indication of the presence of the line when a vehicle passes thereover, as well as improved visibility and water drainage.

BACKGROUND OF THE INVENTION

Driving a motor vehicle during dry, daylight hours is a relatively simple task requiring one merely to obey the traffic signals and keep the vehicle within the proper traffic lane as defined by the markings on the road. This relatively simple task becomes a particularly exasperating and often treacherous assignment when darkness and wet weather conditions prevail. Under these conditions, the usual night driving handicap of reduced visibility is augmented by the wet weather conditions, thereby making reflective road markings virtually imperceptible.

Road markings are generally made by using hot or cold traffic stripe paint, cold tape, or more durable materials such as epoxies or thermoplastics. Road markings generally come in two forms, long line stripes and transverse stripes. Long line stripes are typically four inches wide and include a solid line, an interrupted line, a pair of solid lines, or a solid line in combination with an interrupted line. The interrupted lines include a series of predetermined length traffic stripes separated by a series of predetermined length gaps. Interrupted lines are generally used with solid lines when center turn lanes (i.e., left-hand turn lanes in the United States) are applied, for example, to a three lane road. When two lines are used together, they are normally spaced four inches apart from each other. However, the spacing and dimensions of a traffic stripe can differ according to different country, state, country and city regulations.

Transverse stripes are normally short markings or legends. Transverse lines are normally considered to be stop bars, crosswalks, railroad crossing markings, words such as "ONLY", arrows, symbols and other markings and legends of that nature. Because cars often stop on transverse markings, these lines are usually directly subject to the power applied to the wheels of a car during acceleration. As a result, transverse lines generally experience more wear than long line stripes. Consequently, transverse lines are normally thicker than long line stripes.

Generally, when thermoplastic is used, stripes are applied in thicknesses of sixty to one hundred and twenty-five thousandths of an inch, and preferably, they are applied at ninety to one hundred and twenty-five thousandths of an inch. Also, reflective materials may be added on top of the traffic stripe to give it increased reflectivity at night. The reflective material primarily consists of glass beads applied on top of the traffic stripe after the stripe has been applied to the road surface.

Water does not drain from conventional road markings during wet weather conditions. As a result, when it is raining, a thin film of water will form on top of the traffic stripe and significantly reduce the retroreflectivity of the glass beads used therein. If a thick film of water forms on top of the traffic stripe, such as encountered in a heavy storm, the water will totally obscure the markings from view, thereby making them completely ineffective.

Because of the deterioration in traffic guidance conditions that occurs during dark and wet driving conditions, the incidence of traffic accidents increases and the usual smooth flow of traffic is impeded. Attempts have been made to eliminate these dangers by providing individual raised reflectors on the road surface, by using large reflective elements in road markings that protrude above the water film, and by forming profiled road markings having thickened transverse portions projecting above the water film.

One of the most widely used marking systems in the United States is an individual raised reflector, such as that available under the tradename Stimsonite® 948 or that shown in U.S. Pat. No. 3,332,327. The reflector generally comprises an approximately four and one-half inch by two and one-half inch marker that is raised one-half inch from the road and has sloped side surfaces. A reflective panel is disposed on each of the sloped sides of the marker and the entire top surface is then covered with a plastic or glass coating. As an example, these individual markers are placed every forty feet or so, such that one hundred thirty-two of them are used for each mile of road marking to help motorists when driving during dark and wet weather conditions. The markers are secured to the road using an epoxy glue or an adhesive, however, a problem with maintaining the markers on the road surface exists. For instance, on a hot summer day when the asphalt is especially soft, a heavy truck running over a marker will push it into the asphalt below the surface of the road. Heavy trucks also knock these markers off the road, thereby leaving a hole in place of the marker. In both instances, the effectiveness of the reflective marker is destroyed. The cost for such individual markers and their installation is also a significant drawback since using them on top of road striping can increase the cost of road markings by four hundred dollars per mile, or more, depending upon the spacing of the markers.

As an alternative to reflective markers, large glass beads have also been used to provide a profiled road marking having a pebble-like finish. In this system, produced by R.S. Clare & Co. Limited under the trade name Aquaflex™, large one to four millimeter glass beads and small crushed stones are spread on top of a binder coat layer and then coated with paint. Smaller conventional reflective beads are then dispersed over the painted line. Portions of the large glass beads are able to protrude above thin water films on the road surface thereby providing a reflective surface. However, using this type of large glass bead substantially increases costs, and since the larger beads are not universally accepted for road marking, approval on a state by state basis is required. Further, because of their size, the large glass beads do not adhere well to the road marking and have a tendency to be dislodged by traffic.

A further marking system used primarily in Europe is generally described in U.K. Patent Application 2,121,462. This marking system uses a relatively thick striping material extruded through a shaped die. The striping is applied in a line approximately one and one-half to three millimeters thick and at intervals of every ten to fifty centimeters. The die is raised to increase the outflow of the striping material and thereby form a wavy transverse ridge approximately five to ten millimeters thick. The striping material generally includes glass beads mixed therewith and additional glass beads are preferably sprinkled on top of the applied marking before it is completely hardened. The spaced ridges form a profiled marking having raised retroreflective surfaces at specified intervals that will project above the surface of a water film and thereby provide visible markings during dark and wet weather conditions. However, glass beads covering the raised ridges soon wear away due to the constant travel of traffic and, eventually, even the raised ridges themselves will wear down. Therefore, within a relatively short period of time, the increased visibility provided by the profiled marking is destroyed. In addition, the thickness of the marking prevents the water from properly draining from the road surface when the marking is applied as an edge line. This creates a pocket of standing water at the edge of the road surface that may cause vehicles to skid, thereby increasing the number of accidents.

U.S. Pat. No. 5,511,896 to Marcato, the entire contents of which are hereby incorporated by reference, uses an apparatus that applies a thermoplastic stripe to the road surface, and a layer of reflective material to the thermoplastic stripe. The apparatus also passes a rotatable wheel having a plurality of projections around its periphery over the thermoplastic stripe such that the stripe is deformed and spaced grooves are formed therein. An anti-adhesion agent, such as water, is preferably sprayed onto the rotatable wheel before the deforming step to prevent the still warm thermoplastic stripe from adhering to the wheel. An appropriate amount of water is sprayed on the wheel to cause a layer of reflective beads to adhere to the wheel and thereby prevent adhesion of the thermoplastic material. The plurality of grooves formed in the thermoplastic stripe assist in draining the water from the stripe during wet weather. However, drivers must still visually spot the line to determine its presence.

A strong need therefore exists for a durable and economical way to apply road markings that allow water to drain from the road surface, provide an audible signal to a driver when a vehicle passes there over, and have increased reflective properties so that they are visible at night during wet weather conditions.

SUMMARY OF THE INVENTION

The apparatus of the present invention for applying a traffic stripe to a road surface comprises at least one vehicle and a first applicator operatively attached to the vehicle for applying a traffic stripe material to the road surface. The first applicator includes a first member securable in a first position for allowing the material to be applied to the road surface and in a second position for preventing the material from exiting the applicator. The first applicator also includes a second member that is capable of being adjustably positioned such that it forms a traffic stripe with at least a first portion having a first height and at least a second portion having a second height, wherein the height of the second portion is greater than the height of the first portion. The first and second members each include a shutter and means for controlling its operation. The apparatus also comprises a second applicator for applying a reflective material to the traffic stripe and a deformation member spaced from the first applicator for providing a profile to the first and second portions of the traffic stripe while maintaining the second height greater than the first height.

In a preferred embodiment of the invention, the deformation member comprises a rotatable wheel including a plurality of projections and grooves which contacts and deforms an upper surface of the first portion of the line, and a lifting mechanism is provided for raising the wheel so that it can deform an upper surface of the second portion of the line if necessary. In another embodiment the deformation member includes a rotatable wheel having a plurality of grooves and a first set of projections extending from an inner surface of at least one first groove to an outer periphery of the wheel and a second set of projections extending from an inner surface of at least one second groove to a location spaced inwardly from the outer periphery of the wheel. The distance from the outer periphery of the wheel to the inner surface of the second groove located between a pair of the second set of projections is greater than the distance from the outer periphery of the wheel to the inner surface of the first groove located between a pair of the first set of projections.

The preferred method of the present invention for applying a traffic stripe to a road surface comprises the steps of providing an applicator having first and second members, applying a material forming a traffic stripe to a road surface by opening the first member, forming the traffic stripe with at least a first portion having a first height and at least a second portion having a second height by selectively positioning the second member in first and second open positions, respectively, and deforming the first and second portions of the traffic stripe with a deformation member to form grooves in the traffic stripe while maintaining the second height greater than the first height.

The deforming step includes serially passing the deformation member comprising a rotatable wheel having a plurality of projections spaced from one another over the traffic stripe. The deforming step further includes preventing the projections from contacting the road surface so that a base layer of the traffic stripe material is formed on the bottom of a resulting groove formed in the traffic stripe material.

The traffic stripe according to the present invention comprises a line of thermoplastic material having certain thixotrophic qualities and including at least one first portion having a thickness of at least 0.0625 inch and at least one second portion having a thickness of at least 0.5 inch, wherein the thickness of the second portion is greater than that of the first portion. A reflective coating is dispersed over the line of thermoplastic material and a plurality of grooves having a depth of at least 0.04 inch are formed in at least the first portion of the line of thermoplastic material. Each groove includes at least one side wall having a portion disposed at an angle of less than ninety degrees relative to a horizontal, wherein the plurality of grooves allows water to drain from the line of thermoplastic material, and the angled side walls of each groove provide the traffic stripe with increased reflectivity.

BRIEF DESCRIPTION OF THE DRAWINGS

The above description and other objects, advantages, and features of the present invention will be more fully understood and appreciated by reference to the specification and accompanying drawings, wherein.

DETAILED DISCUSSION OF THE PREFERRED EMBODIMENTS

Figure 1:
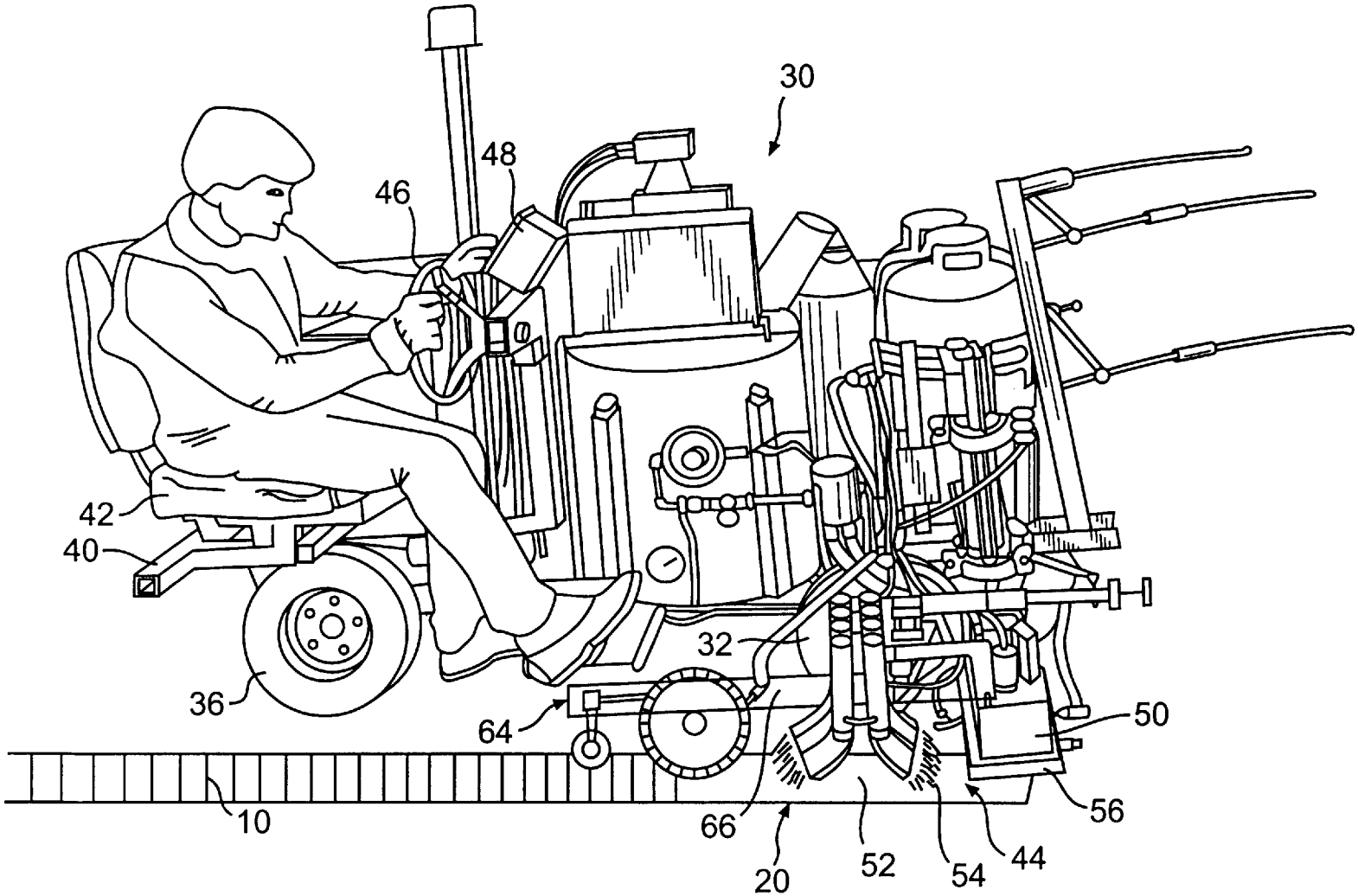
FIG. 1 is a right-side view of a vehicle including a preferred embodiment of an apparatus for applying a night-visible traffic stripe to a road in accordance with one embodiment of the present invention.
Figure 2:
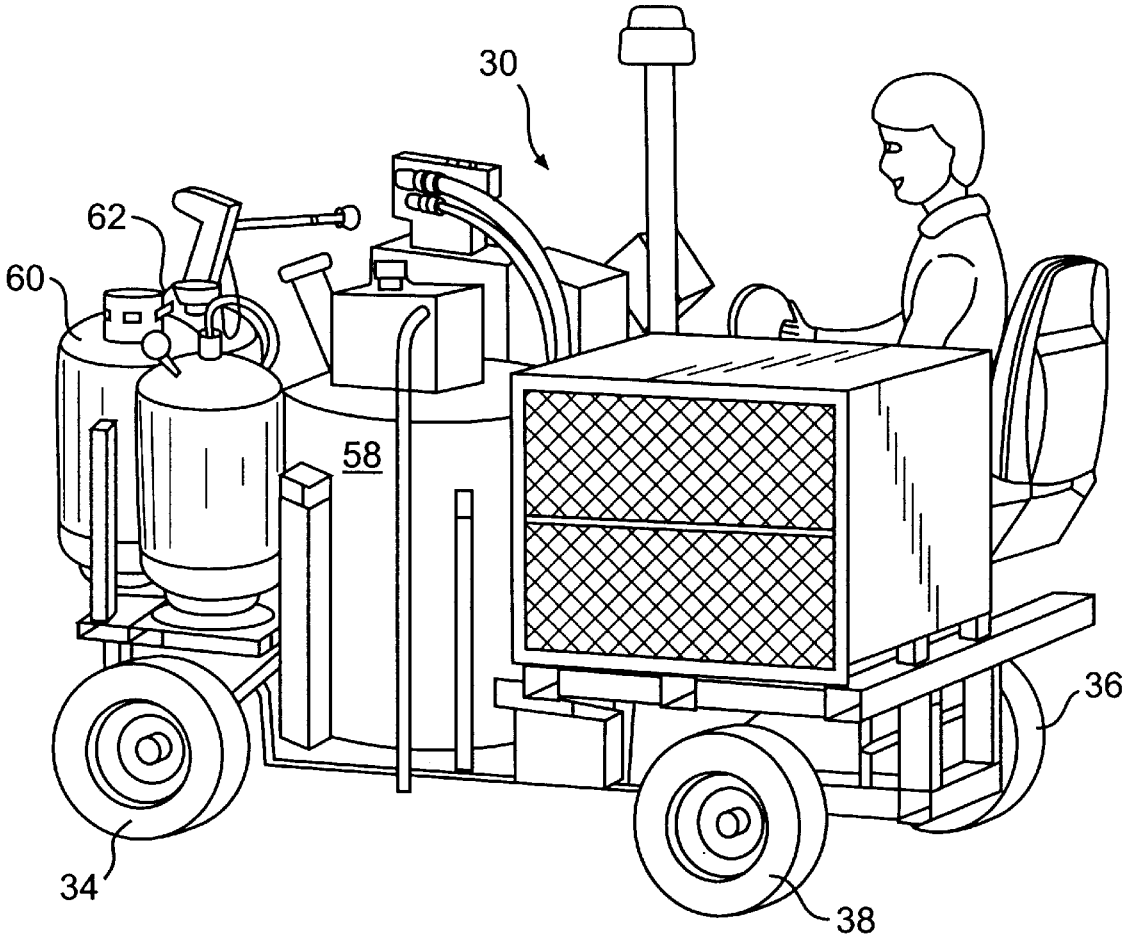
FIG. 2 is a left-side perspective view of the apparatus of FIG. 1.

Referring to FIGS. 1 and 2, a preferred apparatus 20 for applying a traffic stripe 10 to a road surface is shown attached to a vehicle 30, such as that manufactured by Mac Stripers, Inc. under Model No. TM 4000. Vehicle 30 includes a pair of front wheels 32 and 34 and a pair of rear wheels 36 and 38. Other types of vehicles may also be used with the present invention as disclosed in further detail in U.S. Pat. No. 5,114,268 issued May 19, 1992, the disclosure of which is hereby incorporated by reference, and U.S. Pat. No. 5,511,896 issued Apr. 30, 1996, to the same inventor as the present invention. Apparatus 20 may be attached to any vehicle, motorized or otherwise powered, for applying a traffic stripe depending upon the desired marking and should, therefore, not be limited to the vehicles shown and described herein. However, for the purpose of discussing the application of traffic stripes according to the present invention, specific reference will be made to vehicle 30.

Vehicle 30 uses a heavy-duty hydrostatic drive system. This system uses an infinitely variable speed drive for forward and reverse with a single foot control peddle that also serves as the primary braking system. In addition, included is an optional emergency air-operated friction brake that acts on the rear wheels. A twenty horse power engine is used for propelling the vehicle up to six miles per hour in a forward or reverse direction.

Disposed outward of and adjacent to front wheels 32 and 34, in FIGS. 1 and 2, is a system 44 for applying a traffic stripe to a road. Thermoplastic is a durable line marking material that should last up to ten times as long as traffic paint on the same location. Thus, it is preferable to include a thermoplastic stripe applying assembly 50 in the present invention, even though, system 44 could also be used as shown for applying traffic paint, cold tape, epoxy or other materials to form a traffic stripe.

A resin thermoplastic is heated in accordance with well-known principles. The thermoplastic is normally heated in a tank to between 350° F. and 450° F., but preferably approximately 400° F. This heated thermoplastic is then delivered through gravity or under pressure from a pump or pressure vessel to stripe applying assembly 50. Thermoplastic is normally applied in generally straight lined stripes at 400° F. so that it bonds to the road. Although thermoplastic bonds better on an asphalt surface, it can be effectively used on concrete surfaces as well.

At least three different methods for applying thermoplastic to the road presently exist. One uses an extrusion or screed assembly, the other uses a ribbon gun or aimless ribbon gun assembly, and the third uses an air atomized spray assembly. Although an air atomized spray or ribbon gun assembly could be used, an extrusion assembly is the preferred thermoplastic stripe applying assembly 50 of the present invention.

Vehicle 30 includes a holding tank 58 of thermoplastic having a capacity of approximately four hundred pounds although tanks having greater or lesser capacity could, of course, also be utilized with the thermoplastic stripe applying assembly 50 of the present invention. Under the holding tank is a burner for heating the thermoplastic from between 350° F. and 450° F. Preferably, two thirty pound propane tanks 60, 62 are used for the heating system. Sometimes the thermoplastic is heated and immediately conveyed to the road and other times it is heated and stored briefly before conveyance to the stripe application system. A thermoplastic suitable for screed extrusion can be used with apparatus 50 of the present invention. In a preferred embodiment a thermoplastic is used having a viscosity of 12,000–14,000 Centipoise when in a liquid state at the time of application. An example of such a thermoplastic is available under the trade name RainLine™ manufactured by The RainLine Corporation, Inc. Other available thermoplastics having a viscosity of at least 4,000 Centipoise in a liquid state at the time of application and that are thixotrophic in nature could also be used.

Figure 3A:
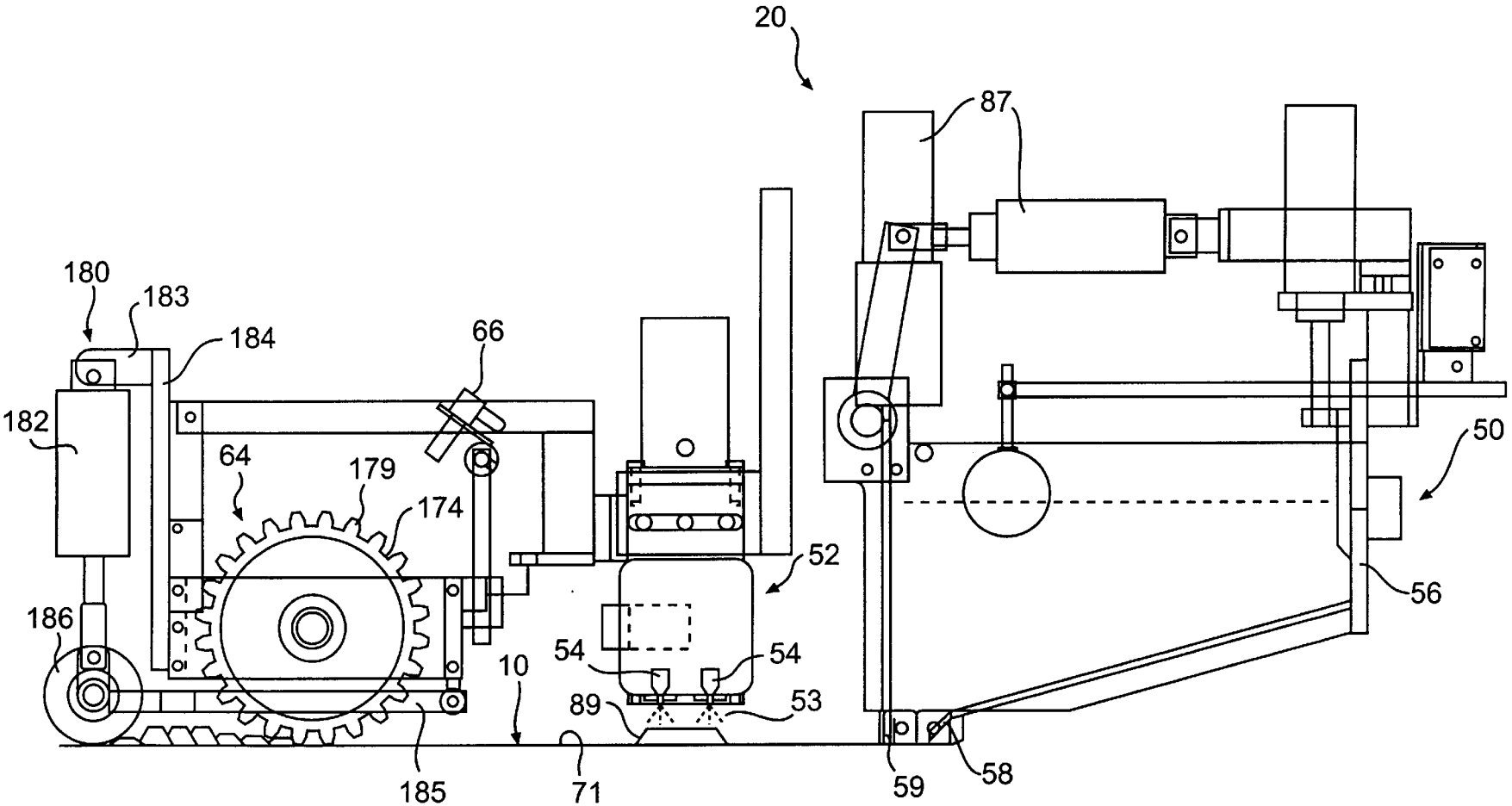
FIG. 3A is an exploded schematic of an apparatus for applying a night-visible traffic stripe in accordance with the present invention.

Referring also to FIG. 3A, traffic stripe applying system 44 is shown applying a continuous traffic stripe to a road. In this instance, the thermoplastic stripe 10 is applied using an extrusion assembly, as discussed above. Also shown is an assembly 52, disposed rearward of and in alignment with the thermoplastic stripe applying assembly 50, for applying or spraying reflective material 53 over the applied thermoplastic stripe 10. Preferably, the reflective material 53 is held in a tank on the vehicle with a capacity of approximately one hundred twenty-five pounds and is fed, when desired, under a pressurized system. Reflective material applying assembly 52 includes at least one jet outlet 54 through which a reflective material 53 is dispersed from a holding tank. Reflective material applying assembly 52 could also include a drop-on bead gun from which the reflective material 53 is fed under gravity onto the thermoplastic stripe. In a further embodiment of the present invention, two outlets 54 could be used to apply the reflective material 53. Still further, a first jet outlet may deliver approximately 20 percent of the total reflective material 53 utilizing an air atomized bead gun that applies the reflective material 53 under a preferred pressure of thirty pounds. The first outlet may also be provided with a rubber shield to reflect the sprayed material back toward the thermoplastic stripe. The second outlet may then dispense the remainder of the reflective material 53 as a gravity fed ribbon of the material. The reflective material 53 preferably comprises a plurality of fine glass beads. Glass beads meeting the specification of AASHTO M247—Type 1 and having a sieve size of approximately −20 to +80 can be used. The present invention should not be limited to the use or size thereof, since assembly 52 could be adapted for use with any size particulate reflective material 53.

To apply thermoplastic stripe 10 as either a continuous reflective stripe or an interrupted stripe, from thermoplastic stripe applying assembly 50, requires a certain arrangement of the assembly outlets as well as easily adjustable controls for controlling the opening and closing of a portion of the assembly so that the stripes and gaps of predetermined length can be repeatedly applied. Such an electronic control means to direct the appropriate mechanical elements in assembly 50 is described in U.S. Pat. No. 3,477,352 to Harding, et al., which is hereby incorporated by reference. The electronic control means described in U.S. Pat. No. 3,477,352 to Harding, et al. can also control reflective material applying assembly 52 such that the reflective material 53 is primarily applied or sprayed only over the thermoplastic stripe 10, as shown in FIGS. 1 and 3A. The control means includes a plurality of electrical switches mounted on a control box 48 that is located near the driver's seat.

Thermoplastic stripe applying assembly 50 includes, as shown, a housing 56 preferably having four sides and a plurality of shutters for controlling the flow and size of the thermoplastic stripe. A first shutter 58 controls the quantity of the thermoplastic material extruded from the assembly 50 and the amount of time the material is extruded. Shutter 58 is positioned between the outlet and the road surface to prevent the thermoplastic material from being applied to the road surface unless the shutter 58 is in an open position. When the shutter is secured in the open position, the thermoplastic material is extruded from the outlet onto the road surface. When the desired height and length of the stripe have been achieved, the outlet is closed by closing the shutter and thereby preventing the thermoplastic from being applied to the road. The shutter 58 is moved forward and rearward to control the length of a stripe or a segment of an interrupted stripe.

Figure 8A:
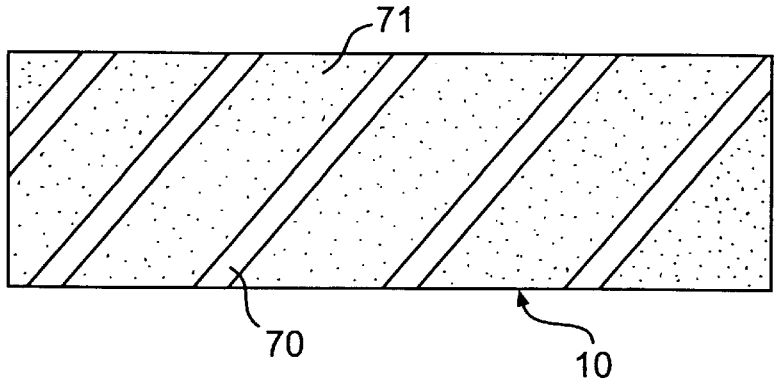
FIGS. 8A–8C are schematics of various traffic stripes according to embodiments of the present invention.

A second shutter 59 is positioned rearward of the first shutter 58 for controlling the height of the extruded stripe so that at least two portions of a stripe or segments of an interrupted stripe can be formed with different heights. The shutter can be locked in any one of a plurality of positions including a first open position which sets the stripe at a first, base line height and a second open position which sets the stripe at a second, raised height for creating raised audible bumps 89. The height position of the second shutter ranges between 0.10 and 0.70 inch with the height of the first position being approximately between 0.10 and 0.15 inch with a preferred position of approximately 0.120–0.140 inch. The height position of the second shutter in the second position is between 0.375 and 0.70 inch with the preferred distance being approximately 0.500–0.625 inch. As a result, the height of the first, base line portion 71 of the stripe is between approximately 0.10 and 0.15 inch, with the preferred height being 0.120–0.140 inch. The height of second portion 89, the raised, audible bump formed when the shutter is in a second position is between 0.375 and 0.70 inch, with the preferred height being about 0.500–0.625 inch before profiling as discussed below. The second shutter can also assume a third position which provides a height to a portion of the line that is between that of the first and second positions and which forms bumps 189 as shown in FIG. 8A. The height created by the third position is between 0.35 and 0.40 inch, with the preferred height being approximately 0.375 inch. Each bump 89 or bump 189 may be approximately 3.0 inches in length and the distance between the raised, audible bumps is between ten and thirty-six inches, with the preferred distance being approximately twenty-two inches. The second shutter can not move from a closed position to one of the open positions without the first shutter being open. The thermoplastic material is fed to housing 56 under pressure which allows a forward speed of approximately two miles per hour. Both shutters are controlled by an air cylinders 87, however, other conventional manners of controlling the position of a shutter could also be used.

Figure 3B:
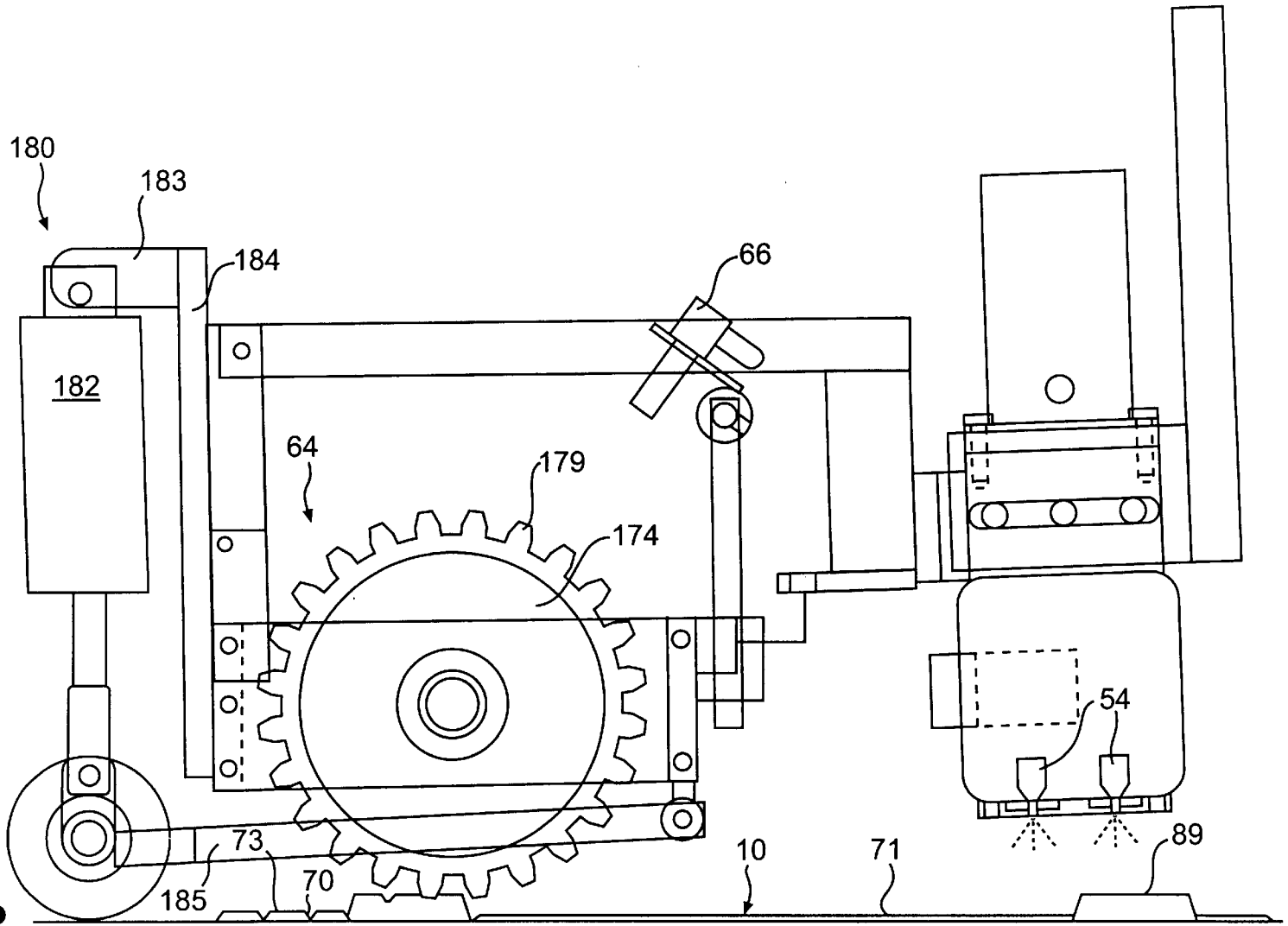
FIG. 3B is an exploded partial schematic of the apparatus for applying a traffic stripe profiling a raised, second portion of a traffic stripe in accordance with the present invention.
Figure 3C:
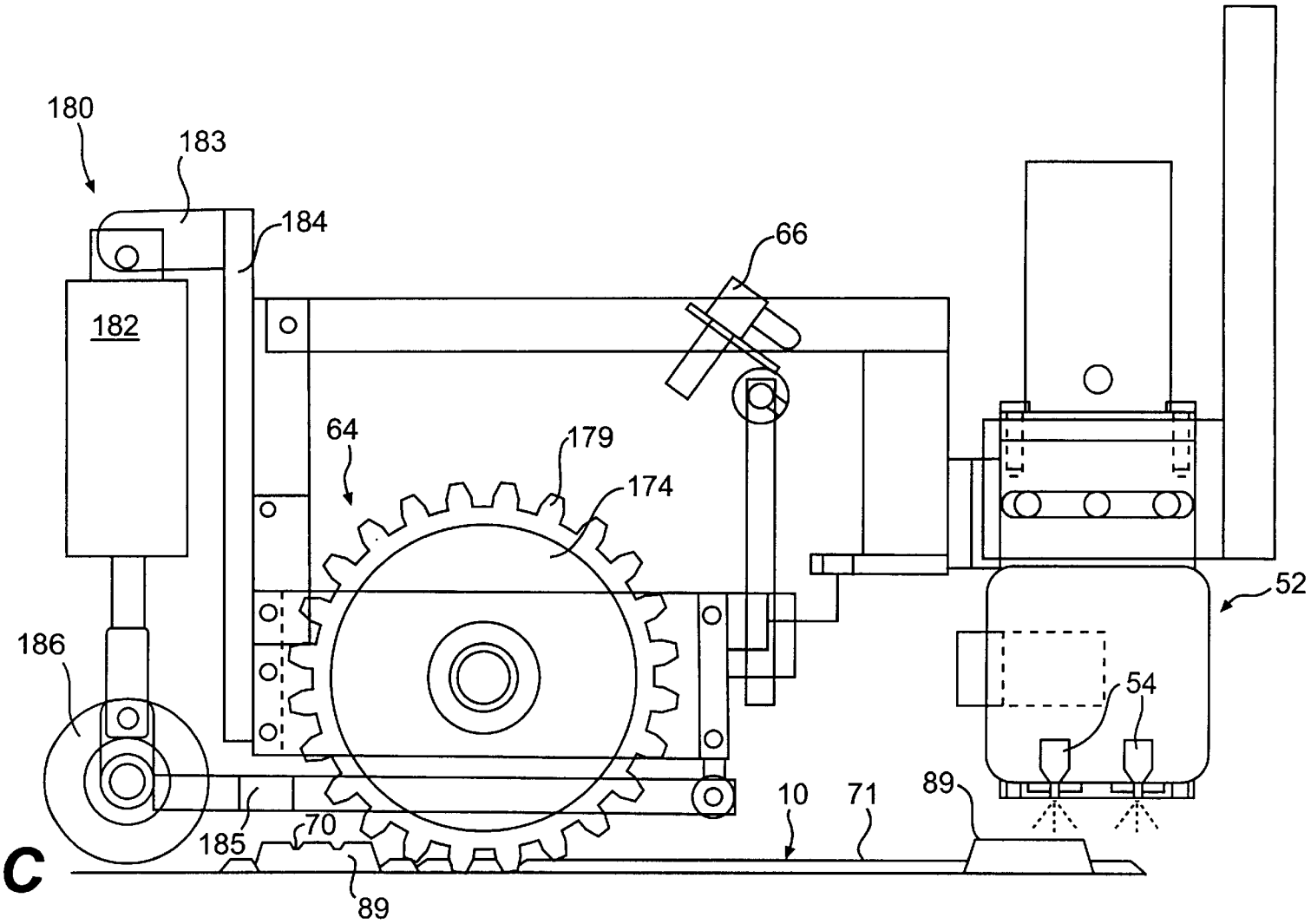
FIG. 3C is an expanded partial schematic of the apparatus for applying a traffic stripe profiling a first portion of a traffic stripe in accordance with the present invention.

In addition to the thermoplastic stripe applying assembly 50 and reflective material applying assembly 52, the present invention further provides a rotatable wheel assembly 64 and a releasing agent or anti-adhesion agent assembly 66 disposed rearward of thermoplastic stripe applying assembly 50 and reflective material applying assembly 52. As shown in FIGS. 3A–3C, wheel assembly 64 includes a wheel 174 having a plurality of spaced projections 179 which form corresponding grooves 70 in the thermoplastic stripe 10 when the wheel 174 passes thereover. In accordance with a further embodiment of the invention, as shown in FIGS. 4–6, wheel assembly 64 may include a wheel 74 having a plurality of spaced projections 68 on first and second portions of the wheel which form corresponding grooves 70 in the thermoplastic stripe 10 when the wheel 74 passes thereover.

Because the thermoplastic must be applied at a temperature of approximately 400° F. in order to bond to the road, the thermoplastic will also bond to wheel 74, wheel 174 or any other structure passing there over immediately after its application. Thus, a releasing agent or anti-adhesion agent of some kind must be used to prevent the adhesion of the freshly applied thermoplastic to wheel assembly 64. In the preferred embodiment, as illustrated in FIG. 3A, anti-adhesion agent assembly 66 is disposed above the top surface and forward of wheel 174. As shown in FIG. 4, anti-adhesion agent assembly 66 is disposed forward of wheel 74 such that a releasing agent or anti-adhesion agent is applied to the periphery of wheel 74 prior to its contact with thermoplastic stripe 10. Any location elsewhere on the periphery of wheel 74 or wheel 174 would also be possible according to the present invention so long as the anti-adhesion agent prevents adhesion of the thermoplastic stripe to the wheel.

Figure 8B:
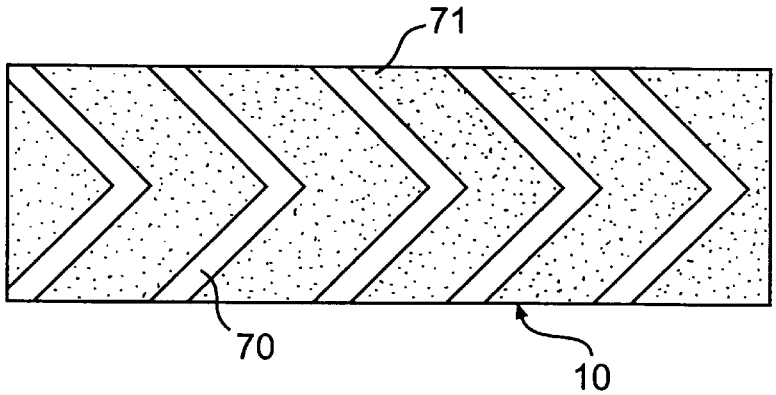
Figure 8C:
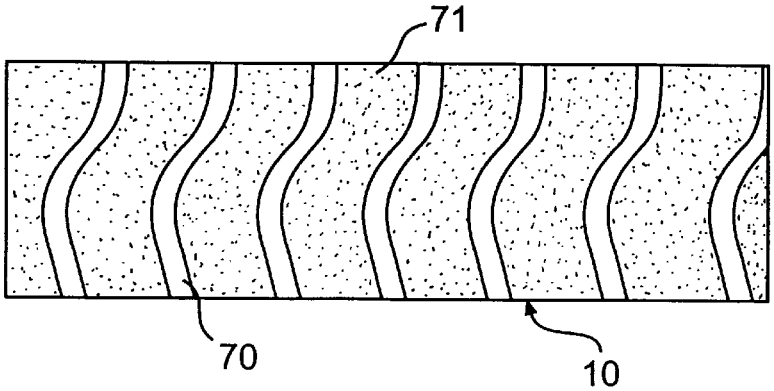

In a first preferred embodiment, illustrated in FIGS. 3A–3C, a wheel 174 can be used to profile the traffic stripe 10. Wheel 174 has a plurality of projections 179 spaced along its outer periphery. Wheel 174 forms grooves in a first portion of the thermoplastic stripe 10 by rolling over it in the same manner as discussed below for a first portion of wheel 74 and as described in U.S. Pat. No. 5,511,896. In order to apply grooves to the second, audible bump portion 89 of the stripe, wheel 174 is lifted up and onto the bump 89 by a lifting mechanism 180 that includes a hydraulic cylinder 182 and a lifting arm 184 connected to the hydraulic cylinder by a linkage bar mechanism 183. When the hydraulic cylinder 182 receives a signal from a control means to raise the wheel 174 up and over the audible bump 89, the cylinder raises the arm 184, which in turn lifts the wheel 174 so that it can either profile or pass over the audible bump 89. Thus, bumps 89 may remain smooth or have grooves 70 formed in the upper surface as shown in FIGS. 8B and 8C. The wheel 174 is connected to a ground wheel 186 by a sync member 185 which can include a belt, connecting bar, or chain. The control means for raising the wheel may be based upon a timing mechanism which measures the revolutions of the wheel or pulses as the wheel rotates. Upon the raising of the wheel, the control means resets and starts the timing over. The ground wheel 186 is offset from wheel 174 so that it will not travel through the wet stripe.

Figure 4:
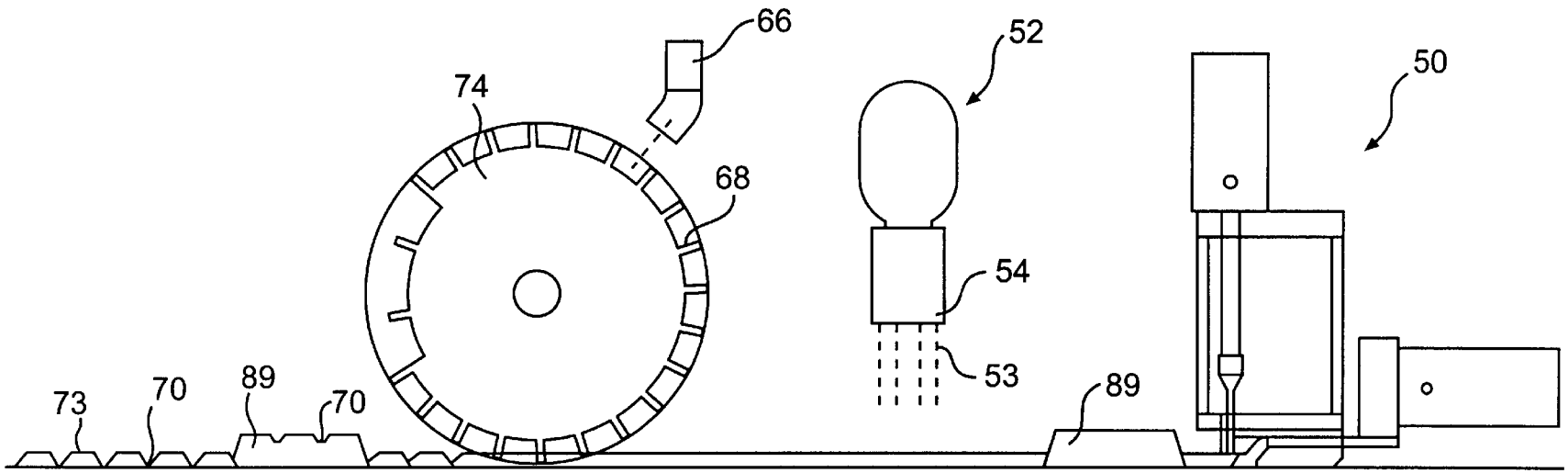
FIG. 4 is an exploded schematic of an apparatus for applying a traffic stripe in accordance with a further embodiment of the present invention.
Figure 5:
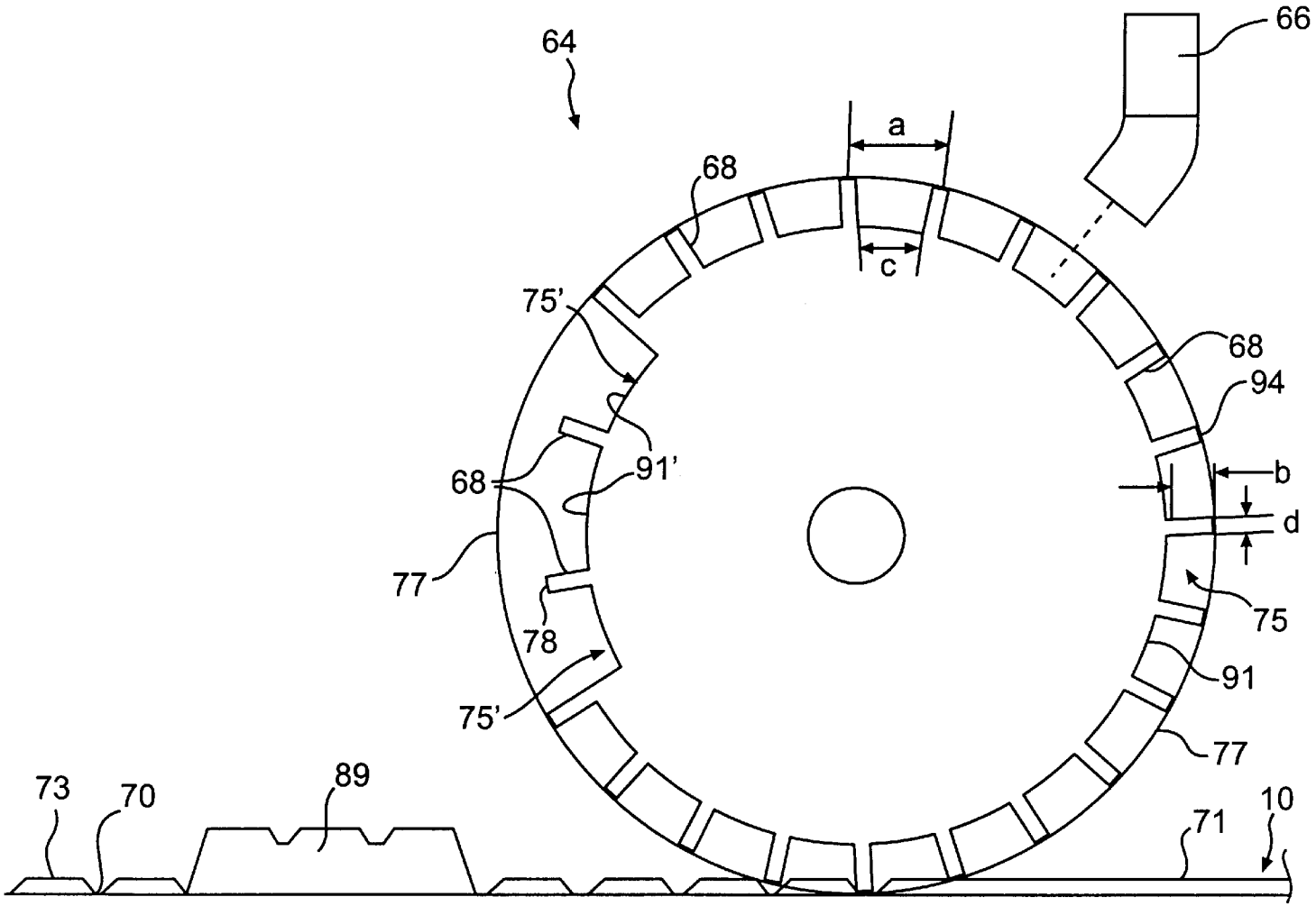
FIG. 5 is a side elevational view of the wheel shown in FIG. 4 deforming a first portion of a traffic stripe.
Figure 6:
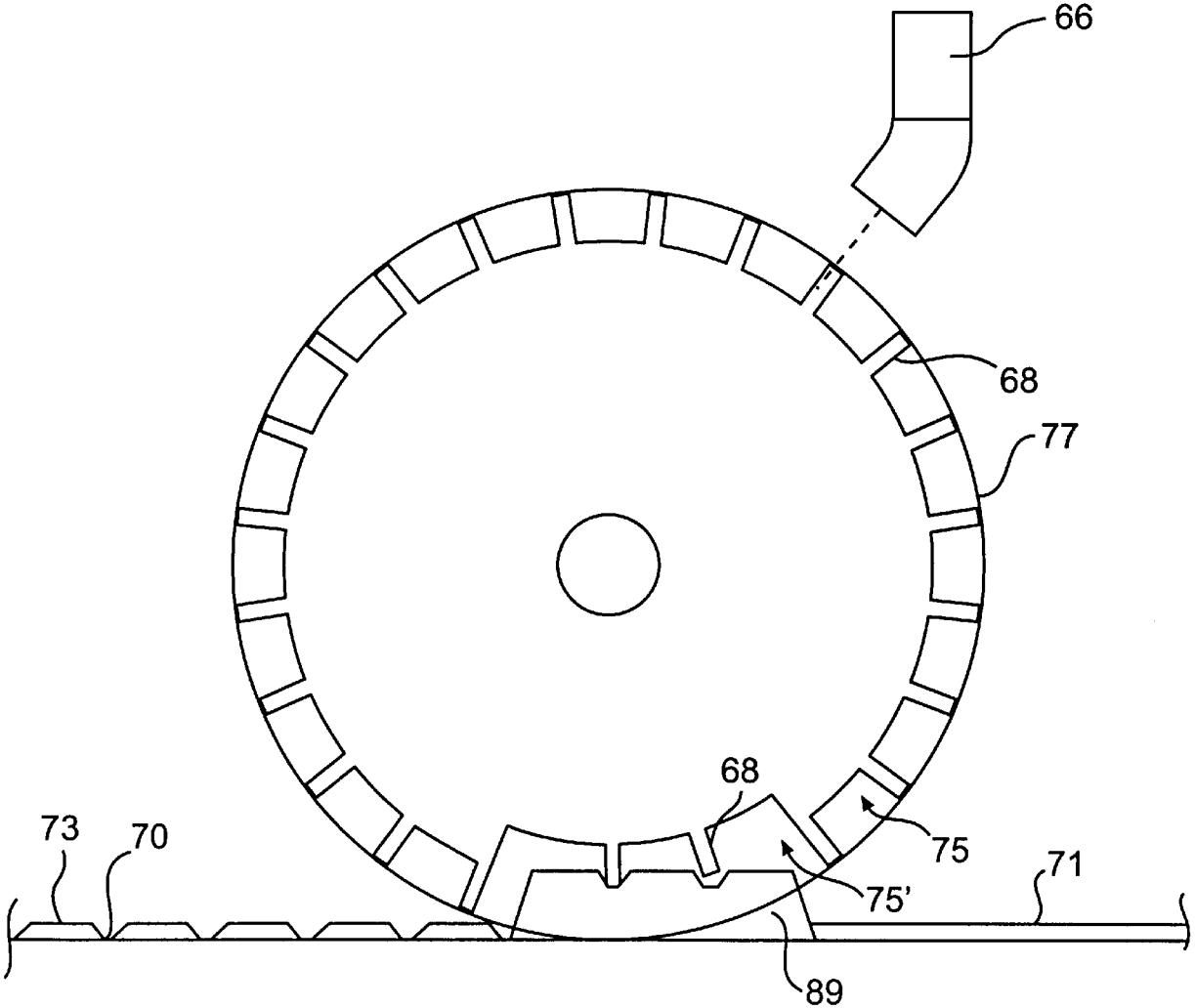
FIG. 6 is a side elevational view of the wheel shown in FIG. 4 deforming a second portion of a traffic stripe.
Figure 7A:
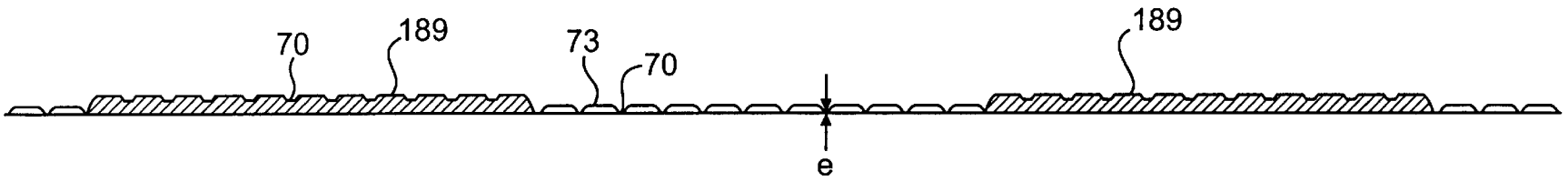
FIGS. 7A–7C are elevational views of various traffic stripes according to embodiments of the present invention.
Figure 7B:
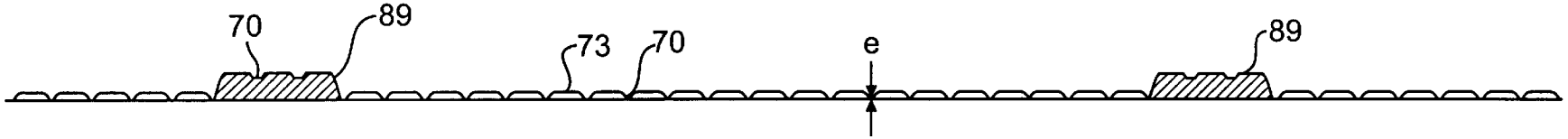
Figure 7C:
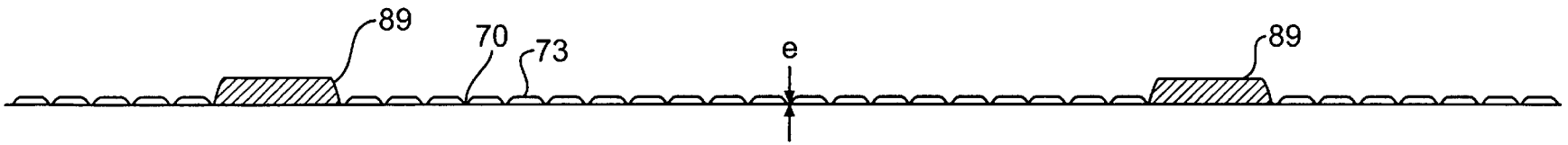

Referring to FIGS. 4–6, a further embodiment of the invention including wheel 74 is shown. The preferred diameter of wheel 74 for deforming the stripe 10 is approximately seven inches in order to accommodate the desired speed of vehicle 30, but smaller diameters or larger diameters in the range of twelve to fifteen inches may also be used. In the illustrated embodiment, projections 68 are spaced along the outer peripheral surface of the wheel 74 with a first portion of the wheel including a first set of projections and a second portion of the wheel including a second set of projections. Projections 68 are disposed to create the grooves 70 in the thermoplastic stripe which increase the reflectivity of the line. Grooves 70 are spaced between 0.25 and 2.0 inches apart and have a minimum depth of 0.04 inch. The raised portions 73 located between the grooves 70 of the resulting traffic stripe have a preferred length of between 0.50 inch and 1.25 inches.

Projections 68 each preferably have a 90 degree angle formed between their substantially flat upper surface 94 and each of their side walls. Rotation of wheel 74 produces a sloped side surface in the resulting grooves 70 and raised portions in the thermoplastic stripe 10 because the angle of the projections as they contact the thermoplastic will not form a 90 degree angle in the thermoplastic stripe, and instead, an angled surface will form, thereby increasing the stripe's reflectivity. Projections 68 can also be formed with angled upper side surfaces in order to provide additional reflective surfaces within the driver's line of vision. When these surfaces have an angle between 30 degrees and 45 degrees, they are effective for producing a thermoplastic line that appears to be continually reflective, despite the fact that the reflective surfaces are spaced apart. When a 30 degree angle is utilized, it is found that the thermoplastic material does not adhere and releases more easily from wheel 74.

The flat upper surface 94 of projections 68 each has a length "d" of approximately 0.125 inch. The first set of projections 68 on the first portion of the wheel extends from the inner surface 91 of a groove 75 between two projections to the outer, peripheral surface 77 of the wheel 74. These projections 68 are spaced apart by a distance "a" preferably between 0.75 and 0.9375 inch and having a depth "b" of approximately 0.4375 to 0.375 inch. They are separated by a plurality of grooves 75 having a width "c" of approximately 0.625 inch and a depth which corresponds to the depth of the projections.

The projections 68 along the second portion of the wheel 74 extend from inner surfaces 91' of a cooperating pair of grooves 75' to a point 78 spaced inwardly from the outer, peripheral surface of the wheel by a distance of approximately 0.375 inch. The grooves 75' along the second portion of the wheel 74 are deeper than those along the first portion; their inner surfaces 91' are spaced a distance of approximately 0.727 inch from the outer peripheral surface of the wheel. Each projection 68 along the second portion has a depth "b" of approximately 0.375 inch and they are spaced from each other by a distance of approximately 1.5 inches. The deeper grooves 75' along the second portion of the wheel provide profiling to the raised portion of the stripe, the audible bump 89, without significantly reducing the profile of the audible bump 89.

In either embodiment, an end disk or rim having a diameter of approximately one-sixteenth of an inch greater than that of the wheel could be disposed on each side of wheel 74 or 174 to hold either wheel above the road surface and prevent the grooves in the thermoplastic stripe from extending down to the bare road surface.

The projections 68 of wheel 74 and the projections 179 of wheel 174 form the spaced transverse grooves 70 in the applied thermoplastic stripe 10 in the illustrated example that are perpendicular to the longitudinal dimension of the traffic stripe. However, it should be understood that any configuration, spacing, or angle of groove would also be satisfactory as long as the grooves provide a reflective surface that can be viewed from a vehicle. In particular, to make a traffic stripe that is durable against the frequent use of snow plows, it is within the scope of the present invention to form diagonal grooves across thermoplastic stripe 10, as shown in FIG. 8A. The use of diagonal grooves maintains the snow plow blade on the uppermost surface of the marking and thus prevents the blade from getting into the grooves below the upper surface of thermoplastic and thus damaging the thermoplastic road stripe. Examples of suitable groove orientations are shown in FIGS. 8A to 8C.

For convenience, the following is described with reference to wheel 174, however, it is to be noted that the below discussions are equally applicable to wheel 74. The preferred anti-adhesion agent used in anti-adhesion agent assembly 66 is a liquid, such as water. It should be understood, however, that other agents could be utilized in the present invention, including, but not limited to, the reflective material used over the traffic stripe or even a permanent anti-adhesion coating on the wheel. Referring to FIG. 3A, system 20 of the present invention is schematically illustrated. Thermoplastic stripe applying assembly 50 applies a continuous or interrupted reflective stripe 10 to the road surface and reflective material applying assembly 52 then disperses a quantity of small glass beads 53 or the like over the stripe 10. Thus, a conventional thermoplastic reflective stripe is obtained. System 20 further provides anti-adhesion agent assembly 66 that applies or sprays water, or another liquid, onto the periphery of wheel assembly 64 before it passes over the still warm thermoplastic stripe 10. The mist or spray of water onto rotatable wheel 174 moistens the outer periphery thereof. An excess of the reflective material or glass beads dispensed from outlet 54 adhere to the moist wheel surface and form a protective covering layer when wheel 174 passes over thermoplastic stripe 10. The protective layer becomes a barrier that prevents the still warm and tacky thermoplastic material from adhering or sticking to the rotatable wheel 174. Therefore, the presence of a releasing agent or anti-adhesion agent such as water or any other suitable material on the wheel assembly prevents the still warm traffic stripe from lifting off the road surface and clogging the corresponding depression on the wheel assembly. It should be noted, however, that if any thermoplastic stripe material is allowed to adhere to wheel 174, the anti-adhesion agent and/or reflective material will not remove the thermoplastic from the wheel. The preferred anti-adhesion agent, water, is immiscible with the thermoplastic stripe material.

Because of this operation, a thermoplastic stripe is obtained which has spaced grooves 70 therein, as shown in FIGS. 3A–3C and FIGS. 7A–7C. The presence of the grooves 70 improves the reflectivity of the line 10 in two ways. First, the presence of grooves within a thick thermoplastic line allows the water to drain from the surface of the road when the thermoplastic line is utilized as an edge striping. Thus, standing pockets of water which interfere with the reflectivity of the stripe are prevented and the hazards of skidding are reduced. Second, the angled surfaces forming the sides of grooves 70 in the thermoplastic stripe 10 provide additional reflective surfaces for the headlights of oncoming cars. The driver's line of vision also perceives the reflection from these angled surfaces and the visibility of the stripe is thus increased. Accordingly, thermoplastic stripe 10 of the present invention provides a reflective traffic marking having improved visibility in wet and dark weather conditions.

In a preferred embodiment of the invention, thermoplastic stripe 10 has a thickness between approximately 0.125 and 0.250 inch and grooves 70 are formed to a depth such that a base of thermoplastic material having a thickness "e" in the range of approximately 0.01 to 0.04 inch, preferably 0.02 inch, remains on the road surface in the area of the groove. It is within the scope of the present invention, however, for thermoplastic stripe 10 to be formed with a thickness between 0.06 and 0.375 inch, or more, such as 0.625 inch.

The base should have a thickness in the above-mentioned range to assure that stripe 10 has an adequate bond area to the road surface, while at the same time allowing water drainage off the driving portion of the road surface. While not preferred, in some applications the base can be omitted by pressing the projections 179 all the way through the thermoplastic material. However, one manner for assuring the proper thickness "e" of the base of the grooves is by using end disks as discussed above. In the disclosed embodiments, the use of an end disk having a diameter one-sixteenth inch greater than the diameter of wheel 174 (the outer diameter defined by projections 179) insures a base thickness of at least 0.03125 inch. Moreover, the spacing between adjacent grooves can also be varied between approximately 0.25 and 2.0 inches, or 4.0 inches, or more.

The preferred technique is to properly adjust and balance the viscosity of the thermoplastic with the weight of wheel 174 and the timing of the formation of the grooves. For example, when using the preferred thermoplastic having a viscosity of 12,000 to 14,000 Centipoise, a wheel having a seven inch diameter and weighing approximately 55 to 60 pounds allows traffic stripe 10 to be formed at two to three miles per hour.

During the preferred operation of the present invention the first step is to apply a traffic stripe, preferably made of a thermoplastic or other profitable material, to the road by opening the first and second shutters 58, 59 which control the flow and height of the profitable material. A layer of reflective material, preferably glass beads, is then applied to the traffic stripe 10. The reflective material can be dropped onto the traffic stripe or applied under pressure. Anti-adhesion agent assembly 66 sprays a fine mist of water or other liquid onto the periphery of wheel 174 while the reflective material is applied to the thermoplastic stripe. The moist wheel 174 then passes over the traffic stripe covered with glass beads. Simultaneously, a thin layer of the beads adheres to wheel 174 while it forms grooves 70 in the traffic stripe. The glass beads form the protective layer that prevents the traffic stripe material from sticking or adhering to wheel 174. In addition, passing the wheel 174 over the traffic stripe serves to embed the reflective material into the molten thermoplastic. As an example, the preferred glass beads will be embedded approximately 50 to 60 percent of their diameter. This results in a more enduring traffic stripe and reflectance readings that are approximately 200 millicandelas brighter than the prior art discussed above.

In another preferred embodiment of the present invention, the anti-adhesion agent can be dispersed directly onto thermoplastic stripe 10 prior to wheel assembly 64 passing there over. The use of an anti-adhesion agent applied only to the thermoplastic stripe is sufficient to prevent the adhesion of the hot thermoplastic to wheel 174, but is not preferred. As with the previous embodiments, the anti-adhesion agent in this instance can be either a liquid or a further coating of the reflective material, such as, small glass beads or the like. When the particulate reflective material is used as the releasing agent or antiadhesion agent, an excess amount of the reflective material is used so that a sufficient amount of the particulate material loosely covers the stripe to prevent the thermoplastic material from sticking to wheel 174. For example, when the above-mentioned beads meeting the specifications of AASHTO M247-Type I are used, 0.14 pounds/foot is applied to a four inch wide stripe and is sufficient to form a reflective layer bonded to the material to work as an anti-adhesion agent. The exact amount that would be required for a given thermoplastic and given application conditions can be readily determined through routine testing, but is generally in the range of twice the usual amount used for reflection purposes alone.

The traffic stripe of the present invention is applied at an approximate speed of between one and three miles per hour. The rate of application for thermoplastic line 10 having a four inch width and maximum thickness of 0.15 inch is approximately 1700 pounds of thermoplastic per linear mile. The corresponding rate of application for the reflective material applied by outlet 54 is approximately 350 pounds per mile and the rate of application for a liquid anti-adhesion agent such as water is approximately 0.2 gallons per minute. At this rate of application, the water causes a layer of beads to adhere to the wheel and thus prevent adhesion of the thermoplastic material. If too little water is applied, adhesion of the beads to the wheel might not occur, while applying the water at too great a rate could wash the beads off.

Although described above as an overall system 20, it is within the scope of the present invention to provide only portions thereof as separate attachments for existing vehicles. That is, the rotatable wheel assembly 64 may be provided as an attachment to a striping vehicle already having all the other necessary components. Alternatively, the wheel assembly 64 and the anti-adhesion agent assembly 66 and/or the lifting mechanism 180 may form a separate attachment for adapting existing equipment to produce the audible profiled line of the present invention.

The method and apparatus for producing a grooved traffic marking have been shown and described above according to the preferred embodiments thereof. Other modifications to the preferred embodiments could include the use of the wheel assembly as a separate detached operation from that of applying the thermoplastic line such as by using a second vehicle. In such a modification, the anti-adhesion agent assembly could be on either the first or the second vehicle. Also, while a separate anti-adhesion agent application assembly is shown, when the anti-adhesion agent used is the particulate reflective material, the excess particulate material can be applied by the reflective material application assembly. It should be obvious to one skilled in the art that various other modifications and alterations can be made without departing from the scope of the present invention, which is to be limited only by claims appended hereto.

What is claimed is:

1. An apparatus for applying a traffic stripe to a road surface, said apparatus comprising:

at least one vehicle;

a first applicator operatively attached to said vehicle for applying a traffic stripe material to the road surface, said applicator including a first member securable in a first position for allowing the material to be road surface and in a second position for preventing the material from exiting said applicator; and a second member capable of being adjustably positioned such that it forms the stripe with at least one portion having a first height and at least one portion having a second height, said second height being greater than said first height;

a second applicator for applying a reflective material to the traffic stripe;

a deformation member spaced from said first applicator; and a lifting mechanism that raises the deformation member at predetermined intervals such that said deformation member forms a profile in said at least one portion of the stripe having a first height and in said at least one portion of the stripe having a second height such that said second height remains greater than said first height.

2. The apparatus according to claim 1 wherein said first member of said first applicator includes a shutter and means for controlling the position of said shutter.

3. The apparatus according to claim 2 wherein said means for controlling said shutter includes an air cylinder.

4. The apparatus according to claim 1 wherein said second member of said first applicator includes a shutter and means for controlling the position of said shutter to form said stripe with said portions having said first and second heights, respectively.

5. The apparatus according to claim 4 wherein said means for controlling said shutter includes an air cylinder.

6. The apparatus according to claim 1 wherein said deformation member comprises a rotatable wheel.

7. The apparatus according to claim 6 wherein said wheel includes a plurality of spaced projections around an outer periphery thereof, said rotatable wheel configured such that said spaced projections form corresponding spaced tripe grooves in said traffic stripe when said rotatable wheel passes thereover.

8. The apparatus of claim 7 wherein said plurality of projections include a first set of projections extending from an inner surface of at least one first groove to an outer periphery of said wheel and a second set of projections extending from an inner surface of at least one second groove to a location spaced inwardly from said outer periphery of said wheel.

9. The apparatus of claim 8 wherein the distance from the outer periphery of said wheel to the inner surface of one of said grooves located between a pair of said second set of projections is greater than the distance from the outer periphery of said wheel to the inner surface of one of said grooves located between a pair of said first set of projections.

10. The apparatus of claim 7 wherein a plurality of said spaced projections of said rotatable wheel have an outer ground engaging surface.

11. The apparatus of claim 7 wherein said traffic stripe comprises a thermoplastic material, said first applicator applies said traffic stripe while said thermoplastic material is hot, and said deformation member forms said spaced grooves therein while said thermoplastic material is still warm.

12. The apparatus of claim 6 further comprising an applicator positioned to apply an anti-adhesion agent onto said rotatable wheel.

13. The apparatus of claim 12 wherein said anti-adhesion agent comprises a liquid.

14. The apparatus of claim 12 wherein said anti-adhesion agent moistens a peripheral surface of said wheel such that said reflective material adheres thereto and forms a protective layer to prevent adhesion of said applied traffic stripe onto said wheel.

15. A method of applying a traffic stripe to a road surface, said method comprising the steps of:

providing an applicator having first and second members;

applying a material forming a traffic stripe to a road surface by opening the first member;

forming the traffic stripe with at least a first portion having a first height and a second portion having a second height by selectively positioning the second member in first and second open positions, respectively; and deforming the traffic stripe with a deformation member to form grooves in said first portion and said second portion of the traffic stripe while maintaining the second height greater than the first height said deforming step further comprising raising the deformation member so that the deformation member can contact and deform an upper surface of the second portion of the traffic stripe.

16. The method of claim 15 wherein the deforming step includes passing the deformation member having a plurality of projections spaced from one another by a respective one of a plurality of grooves over the traffic stripe.

17. The method of claim 16 wherein the deforming step further includes preventing the projections from contacting the road surface so that a base layer of the traffic stripe material is formed in the bottom of each groove.

18. The method of claim 16 wherein the deformation member includes a plurality of grooves having a depth that is greater than the first height and said deforming step includes serially pressing the projections into the material to form the spaced grooves in the traffic stripe.

19. The method of claim 15 wherein the deformation member comprises a rotatable wheel and a plurality of projections.

20. The method of claim 19 wherein said deforming step includes passing the rotatable wheel over the traffic stripe material such that spaced grooves are formed in the traffic stripe material by pressing the projections into the traffic stripe material.

21. The method of claim 19 wherein said step of deforming the traffic stripe material includes supporting the projections of the rotatable wheel above the road surface while pressing the projections into the traffic stripe material to assure that a base layer of traffic stripe material remains in the bottom of the formed grooves.

22. The method of claim 19 wherein said wheel is supported by a lifting mechanism that raises the wheel.

23. The method of claim 19 further comprising a lifting mechanism including a cylinder for raising and lowering the wheel.

24. The method of claim 19 wherein the plurality of projections include a first set of projections extending from an inner surface of at least one groove in the wheel to an outer periphery of the wheel and a second set of projections extending from an inner surface of at least one groove in the wheel to a location spaced inwardly from the outer periphery of said wheel.

25. The method of claim 15 wherein the applicator includes an extrusion die assembly and said applying step comprises forming a thermoplastic line by extruding the thermoplastic material from the extrusion die assembly.

26. The method of claim 25 wherein said reflective material applying step comprises dispersing the reflective material over the traffic stripe by applying the reflective material with a spray gun.

27. The method of claim 15 wherein the applicator includes a ribbon gun and said applying step comprises forming a thermoplastic line by extruding the thermoplastic material from the ribbon gun.

28. The method of claim 15 wherein the applicator includes an air atomized spray gun assembly and said applying step comprises forming a thermoplastic line by extruding the thermoplastic material from the air atomized spray gun assembly.

29. The method of claim 15 further comprising the step of applying an anti-adhesion agent prior to said deforming step.

30. The method of claim 29 wherein the agent comprises a liquid and the deformation member comprises a rotatable wheel; and said agent applying step comprises applying the liquid onto the rotatable wheel prior to said deforming step such that the liquid moistens the periphery of the rotatable wheel.

31. The method of claim 29 wherein said agent applying step comprises applying the agent onto the traffic stripe material prior to said deforming step.

32. The method of claim 29 wherein the agent comprises a liquid and said agent applying step comprises applying the liquid onto the traffic stripe material prior to said deforming step.

33. A traffic stripe comprising:

a line of thermoplastic material including at least one first portion having a thickness of at least 0.06 inch and at least one second portion having a thickness of at least 0.5 inch wherein the thickness of said second portion is greater than the thickness of said first portion, said thermoplastic material having a viscosity in a liquid state of at least 4,000 centipoise;

a reflective coating dispersed over said line of thermoplastic material;

a plurality of grooves formed in at least said first portion of said line of thermoplastic material, each said groove having a depth of at least 0.04 inch and including at least one side wall having a portion disposed at an angle of less than ninety degrees relative to a horizontal;

wherein said plurality of grooves allows water to drain from said line of thermoplastic material; and wherein said sloped side wall of each said groove provides increased reflectivity to said line of thermoplastic material.

34. The thermoplastic traffic stripe of claim 33 wherein each of said plurality of grooves are spaced at least approximately 0.25 inch apart.

35. The thermoplastic traffic stripe of claim 33 wherein said plurality of grooves extend transversely across said line of thermoplastic.

36. The thermoplastic traffic stripe of claim 33 wherein each of said plurality of grooves has a generally flat bottom surface.

37. The thermoplastic traffic stripe of claim 33 wherein each of said plurality of grooves further includes angled side walls extending from said flat bottom surface to an upper surface of said line of thermoplastic, said angled side walls providing additional reflective surface to said traffic stripe.

38. The thermoplastic traffic stripe of claim 33 wherein an upper surface of said at least one second portion includes a plurality of grooves.

39. The thermoplastic traffic stripe of claim 33 wherein an upper portion of said at least one second portion includes a generally continuous, slightly sloped surface.

40. The thermoplastic traffic stripe of claim 33 wherein said at least one second portion includes a plurality of second portions spaced from one another by at least 12 inches.

41. The thermoplastic traffic stripe of claim 33 wherein a bottom surface of the grooves in said at least one first portion has a thickness of at least 0.01 inch.

42. The thermoplastic traffic stripe of claim 33 wherein the grooves in said at least one first portion extend transversely across the traffic stripe.

43. The thermoplastic traffic stripe of claim 33 wherein the grooves in said at least one first portion extend from a first longitudinal edge of the traffic stripe to a second longitudinal edge of the traffic stripe at a predetermined angle.

44. The thermoplastic traffic stripe of claim 33 wherein the grooves in said at least one first portion have a predetermined configuration.

45. The thermoplastic traffic stripe of claim 44 wherein the grooves have a generally rectangular cross section.

46. An attachment for use on a vehicle for applying a traffic stripe to a road surface, the vehicle including a thermoplastic stripe applying assembly for forming the traffic stripe with at least one first portion having a first height and at least one second portion having a second height, the second height being greater than the first height, said attachment comprising:

a deformation member for forming spaced grooves in the at least one first portion having a first height and in the at least one second portion having a second height such that the second height remains greater than the first height; and a lifting mechanism, said lifting mechanism raising said deformation member when passing over the at least one second portion of the traffic stripe such that said deformation member forms spaced grooves in an upper surface of the at least one second portion.

47. An apparatus for applying a traffic stripe to a road surface, said apparatus comprising:

at least one vehicle;

a first applicator operatively attached to said vehicle for applying a traffic stripe material to the road surface, said applicator including a first member securable in a first position for allowing the material to be applied to the road surface and in a second position for preventing the material from exiting said applicator; and a second member capable of being adjustably positioned such that it forms the stripe with at least one portion having a first height and, at least one portion having a second height, said second height being greater than said first height;

a second applicator for applying a reflective material to the traffic stripe; and a deformation member spaced from said first applicator for providing a profile to said at least one portion having a first height and to said at least one portion having a second height such that said second height remains greater than said first height;

wherein said deformation member includes a first deformation portion and a second deformation portion, the first deformation portion defining a first outer surface of the deformation member and the second deformation portion defining a second outer surface of the deformation member, the second outer surface being spaced inwardly from the first outer surface.

48. The apparatus according to claim 47 wherein said deformation member comprises a rotatable wheel.

49. The apparatus according to claim 48 wherein said wheel includes a plurality of spaced projections around an outer periphery thereof, said rotatable wheel configured such that said spaced projections form corresponding spaced grooves in said traffic stripe when said rotatable wheel passes thereover.

50. The apparatus of claim 48 further comprising an agent applicator positioned to apply an anti-adhesion agent onto said rotatable wheel.

51. The apparatus of claim 50 wherein said anti-adhesion agent comprises a liquid.

52. The apparatus of claim 50 wherein said anti-adhesion agent moistens a peripheral surface of said wheel such that said reflective material adheres thereto and forms a protective layer to prevent adhesion of said applied traffic stripe onto said wheel.

53. A method of applying a traffic stripe to a road surface, said method comprising the steps of:

providing an applicator having first and second members;

applying a material forming a traffic stripe to a road surface by opening the first member;

forming the traffic stripe with at least a first portion having a first height and a second portion having a second height by selectively positioning the second member in first and second open positions, respectively;

providing a deformation member having a first deformation portion and a second deformation portion, the first deformation portion defining a first outer surface of the deformation member and the second deformation portion defining a second outer surface of the deformation member, the second outer surface being spaced inwardly from the first outer surface; and deforming the traffic stripe with the deformation member to form grooves in said first portion and said second portion of the traffic stripe while maintaining the second height greater than the first height.

54. The method of claim 53 further comprising the step of applying an anti-adhesion agent onto the deformation member prior to said deforming step.

55. The method of claim 54 wherein the agent comprises a liquid and the deformation member comprises a rotatable wheel; and said agent applying step comprises applying the liquid onto the rotatable wheel prior to said deforming step such that the liquid moistens the periphery of the rotatable wheel.

56. An attachment for use in applying a traffic stripe to a road surface, said attachment comprising:

a deformation member for forming spaced grooves, said deformation member including a first deformation portion and a second deformation portion, the first deformation portion defining a first outer surface of the deformation member and the second deformation portion defining a second outer surface of the deformation member, the second outer surface being spaced inwardly from the first outer surface.

* * * * *